US007952529B2

(12) United States Patent
Huang et al.

(10) Patent No.: US 7,952,529 B2
(45) Date of Patent: May 31, 2011

(54) DUAL BAND ANTENNA

(75) Inventors: Chih-Yung Huang, Taichung County (TW); Pi-Hsi Cheng, Jhubei (TW); Chang-Jung Lee, Longtan Township, Taoyuan County (TW)

(73) Assignee: Arcadyan Technology Corporation, Hsinchu (TW)

( * ) Notice: Subject to any disclaimer, the term of this patent is extended or adjusted under 35 U.S.C. 154(b) by 366 days.

(21) Appl. No.: 12/292,157

(22) Filed: Nov. 13, 2008

(65) Prior Publication Data

US 2009/0135071 A1 May 28, 2009

(30) Foreign Application Priority Data

Nov. 22, 2007 (TW) ..... 96144318 A

(51) Int. Cl.
*H01Q 1/24* (2006.01)
*H01Q 1/48* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 6,239,765 | B1 | 5/2001 | Johnson et al. | |
| 6,476,769 | B1 | 11/2002 | Lehtola | |
| 7,161,543 | B2 * | 1/2007 | Cheng et al. | 343/702 |
| 7,375,686 | B2 * | 5/2008 | Ku et al. | 343/700 MS |
| 2005/0259013 | A1 | 11/2005 | Gala Gala et al. | |
| 2007/0001913 | A1 * | 1/2007 | Tsai et al. | 343/702 |
| 2007/0096995 | A1 | 5/2007 | Lee | |
| 2007/0229366 | A1 | 10/2007 | Kim et al. | |

FOREIGN PATENT DOCUMENTS

| | | | |
|---|---|---|---|
| EP | 1950833 | A1 | 7/2008 |
| TW | 200719537 | | 5/2007 |
| WO | 2004038857 | A1 | 5/2004 |
| WO | 2005018045 | A1 | 2/2005 |
| WO | 2007012697 | A1 | 2/2007 |

OTHER PUBLICATIONS

European Search Report issued in related EP application No. 08020012.4-1248, dated Feb. 20, 2009, 6 pages.
R. Hossa et al., Improvement of Compact Terminal Antenna Performance by Incorporating Open-End Slots in Ground Plane, IEEE Microwave and Wireless Components Letters, Jun. 2004, pp. 283-285, vol. 14, Issue: 6.
Taiwanese office action dated Dec. 23, 2010, 5 pages.

* cited by examiner

*Primary Examiner* — Hoang V Nguyen
(74) *Attorney, Agent, or Firm* — Bacon & Thomas, PLLC

(57) ABSTRACT

An antenna set on a circuit board is provided. The circuit board includes a signal transmitting unit and a grounding unit. The antenna includes a conductive supporting portion, a radiator and a grounding portion. The radiator operating in a first frequency band includes a feeding branch coupled to the signal transmitting unit for receiving a feeding signal. The grounding portion is connected to the radiator through the conductive supporting portion. The grounding portion includes a slot cavity and a grounding branch. The slot cavity is extended from a top surface of the grounding portion into the interior of the grounding portion. The grounding branch is coupled to the grounding unit. A resonant cavity is formed between the radiator and the slot cavity. The resonance of the resonant cavity operates in a second frequency band.

11 Claims, 12 Drawing Sheets

| Frequency (GHz) | 2.40GHz | 2.45GHz | 2.50GHz | 4.90GHz | 5.40GHz | 5.85GHz |
|---|---|---|---|---|---|---|
| Max Gain (dBi) | -0.05 | 0.72 | -1.01 | 4.06 | 2.43 | 3.49 |
| Average Gain (dBi) | -1.82 | -1.43 | -2.99 | -0.75 | -1.87 | 0.06 |

FIG. 6

| Frequency (GHz) | 2.40GHz | 2.45GHz | 2.50GHz | 4.90GHz | 5.40GHz | 5.85GHz |
|---|---|---|---|---|---|---|
| Max Gain (dBi) | 1.32 | 1.07 | -0.13 | 2.07 | 0.22 | 1.72 |
| Average Gain (dBi) | -1.47 | -1.46 | -2.39 | -1.12 | -2.68 | -1.16 |

FIG. 9

DUAL BAND ANTENNA

This application claims the benefit of Taiwan application Serial No. 096144318, filed Nov. 22, 2007, the subject matter of which is incorporated herein by reference.

BACKGROUND OF THE INVENTION

1. Field of the Invention

The invention relates in general to an antenna, and more particularly to a planar inverse-F antenna (IFA).

2. Description of the Related Art

As science and technology have gained rapid advance nowadays, a large variety of compact antennas have been developed and applied in various electronic devices such as mobile phones and notebook computers. For example, the planar inverse-F antenna (PIFA), which has a compact structure and excellent transmission efficiency and can be easily disposed on an inner wall of an electronic device, has been widely applied in the wireless transmission of many electronic devices. However, most of conventional PIFAs are single band antenna, and can only support a narrower frequency band.

For example, the grounding signal and the signal to be transmitted through the PIFA are respectively transmitted through the exterior conductor layer and the interior conductor layer of the coaxial cable. According to the conventional technology, the exterior conductor layer and the interior conductor layer of the coaxial cable are often soldered to the signal feeding point and the signal grounding point of the PIFA respectively for outputting the to-be-transmitted signals through the PIFA. However, the conventional technology is disadvantaged by the problems that the coaxial cable may come off easily and incurs more cost.

SUMMARY OF THE INVENTION

The invention is directed to an antenna capable of receiving a feeding signal and a grounding signal through the circuit of a printed circuit board (PCB). Compared with the conventional planar inverse-F antenna (PIFA), the antenna disclosed in the invention not only prevents the coaxial cable from coming off easily but also avoids the cost of the coaxial cable.

According to a first aspect of the present invention, an antenna set on a circuit board is provided. The circuit board includes a signal transmitting unit and a grounding unit. The antenna includes a conductive supporting portion, a radiator and a grounding portion. The radiator operating in a first frequency band includes a feeding branch coupled to the signal transmitting unit for receiving a feeding signal. The grounding portion is connected to the radiator through the conductive supporting portion. The grounding portion includes a slot cavity and a grounding branch. The slot cavity is extended from a top surface of the grounding portion into the interior of the grounding portion. The grounding branch is coupled to the grounding unit. A resonant cavity is formed between the radiator and the slot cavity. The resonance of the resonant cavity operates in a second frequency band.

The invention further includes a lateral plate used as a fixing mechanism of the antenna. The lateral plate is vertically connected to the bottom of the grounding portion, so that the antenna, supported by the lateral plate, can be vertically set on the circuit board. During the automatic production process, the feeding branch and the grounding branch can be soldered together on the circuit board with other elements. The lateral plate can be an extension from the bottom of the grounding portion or a separate element connected to the bottom of the grounding portion.

The invention will become apparent from the following detailed description of the preferred but non-limiting embodiments. The following description is made with reference to the accompanying drawings.

BRIEF DESCRIPTION OF THE DRAWINGS

FIG. 6 shows a relationship table of frequency vs. gain of FIG. 4A-FIG. 4C and FIG. 5A-FIG. 5C;

FIG. 9 shows a relationship table of frequency vs. gain of FIG. 7A-FIG. 7C and FIG. 8A-FIG. 8C.

DETAILED DESCRIPTION OF THE INVENTION

The invention discloses an antenna capable of receiving a feeding signal and a grounding signal by the circuit of a printed circuit board (PCB).

Figure 1:
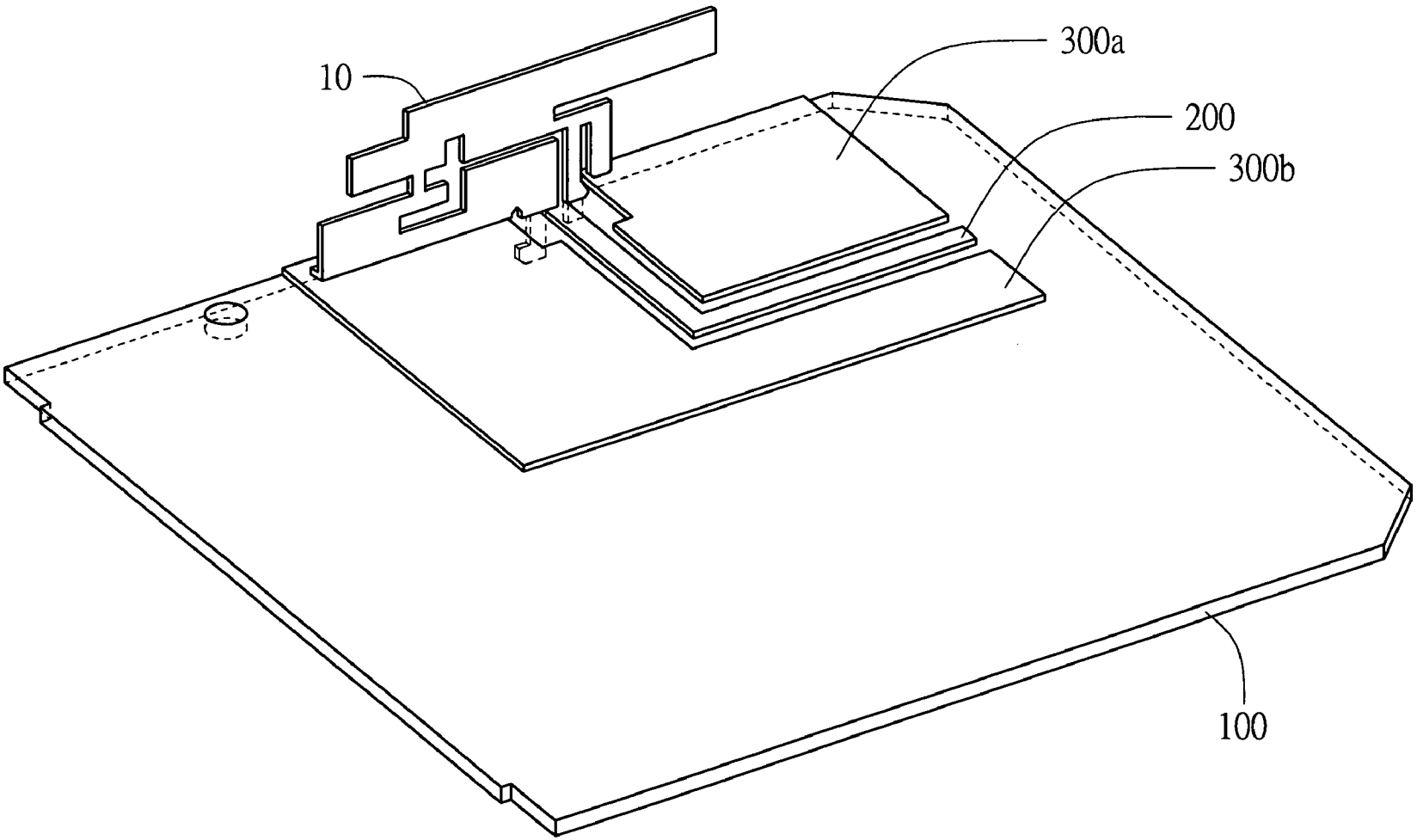
FIG. 1 shows a 3-D perspective of an antenna according to a preferred embodiment of the invention.

Referring to FIG. 1, a 3-D perspective of an antenna according to a preferred embodiment of the invention is shown. The antenna 10 is set on a PCB 100. The PCB 100 includes a signal transmitting unit 200 and two grounding units 300*a* and 300*b* for respectively providing a feeding signal and a grounding signal to the antenna 10.

Figure 2:
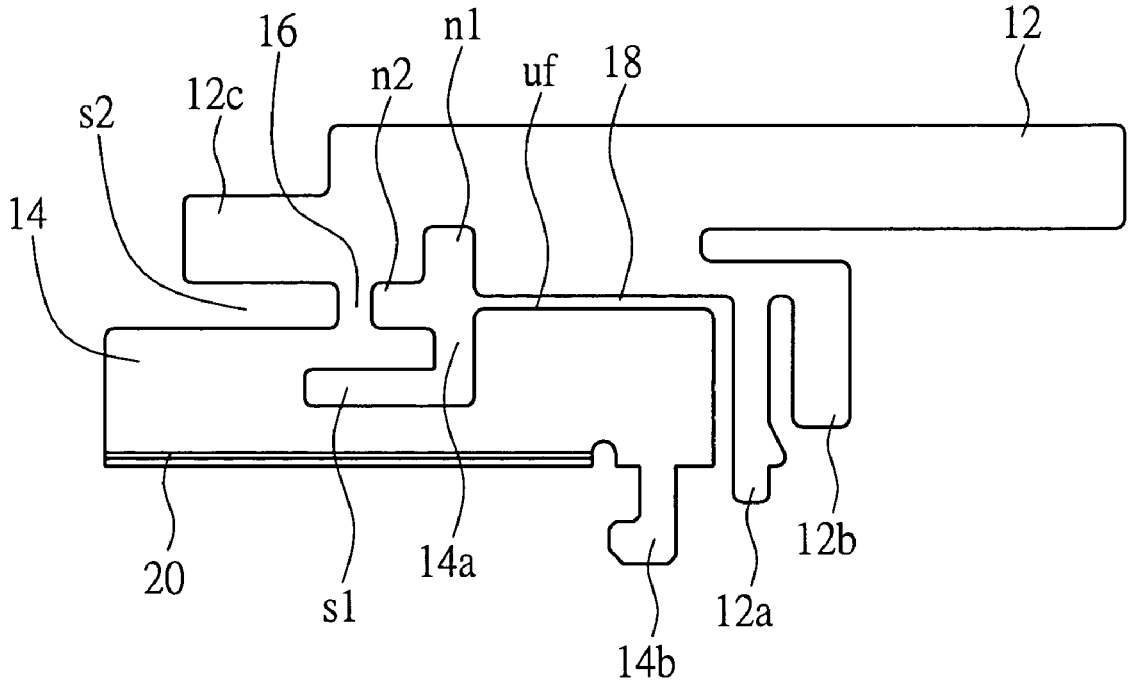
FIG. 2 shows a perspective of the antenna 10 according to a preferred embodiment of the invention.

Referring to FIG. 2, a perspective of the antenna 10 according to a preferred embodiment of the invention is shown. The antenna 10 is applied in an electronic device for transmitting data according to the communication protocol 802.11 a/b/g/n set by The Institute of Electrical and Electronics Engineers (IEEE). The antenna 10 supports data transmission and covers the frequency bands of 2.4 GHz-2.5 GHz and 4.9 GHz-5.85 GHz.

The antenna 10 includes a radiator 12, a grounding portion 14 and a conductive supporting portion 16. The antenna 10 is a PIFA for example, wherein the radiator 12, the grounding portion 14 and the conductive supporting portion 16 are all disposed on the same conductor plane. The thickness of the conductor plane ranges 0.4-0.8 mm.

The radiator 12 is adjusted to operate in a first communication frequency band, wherein the length of the radiator 12 is approximately a quarter of the wavelength of the central frequency of the first frequency band. The radiator 12 includes a feeding branch 12*a* extended down to the other lateral side of the PCB 100 from the radiator 12. A through hole can be disposed on the part of the PCB 100 corresponding to the feeding branch 12*a* extending downward. The feeding branch 12*a* can further have a hooked structure, which is extended to the other lateral side of the PCB 100. The feeding branch 12*a* is electrically connected to the signal transmitting unit 200 for receiving the feeding signal. The connecting point of the feeding branch 12*a* connected to the signal transmitting unit 200 is substantially the signal feeding point of the antenna 10.

The grounding portion 14 is connected to the radiator 12 through the conductive supporting portion 16. The grounding portion 14 includes a cavity 14*a* and a grounding branch 14*b*. The grounding branch 14*b* is extended down to the other lateral side of the PCB 100 from the grounding portion 14. A through hole can be disposed on the part of the PCB 100 corresponding to the grounding portion 14 extending downward. The grounding branch 14*b* can further have a hooked structure, which is extended to the other lateral side of the PCB 100. The grounding branch 14*b* is electrically connected to the grounding unit 300*b* for receiving the grounding signal. The connecting point of the grounding branch 14*b* connected to the grounding unit 300*b* is substantially the signal grounding point of the antenna 10.

The cavity 14*a* is extended from a top surface uf of the grounding portion 14 into the interior of the grounding portion 14. The cavity 14*a* has an L-shaped structure for example. A resonant cavity 18 is formed by the radiator 12, the conductive supporting portion 16 and the cavity 14*a* of the grounding portion 14. The resonant cavity 18 operates in a second frequency band. The second frequency band is higher than the first frequency band for example.

The cavity 14*a* includes a slot s1 disposed in parallel with the top surface uf. The slot s1 has a closed end and an opening end, and the direction of the opening is parallel to the top surface uf.

The radiator 12 includes an indentation n1, wherein the direction of the opening of the indentation n1 is substantially perpendicular to the radiator 12. The indentation n1 and the resonant cavity 18 are interconnected. The radiator 12, the conductive supporting portion 16 and the grounding portion 14 together define an indentation n2, wherein the direction of the opening of the indentation n2 is substantially perpendicular to the direction of the opening of the indentation n1. The indentation n2 and the resonant cavity 18 are interconnected. The radiator 12 further includes a protrusion 12*b* substantially adjacent to the feeding branch 12*a*. In the present embodiment of the invention, the protrusion 12*b* is parallel to the feeding branch 12*a*.

The length and width of the slot s1, the indentations n1 and n2 and the protrusion 12*b* are related to the length of the current path of the resonant cavity 18 and the resonant cavity 18 the impedance of for adjusting and matching the impedance. In the present embodiment of the invention, each of the slot s1, the indentations n1 and n2 and the protrusion 12*b* has a predetermined length and width, so that when the resonant cavity 18 operates in a second frequency band, the resonant cavity 18 and the signal transmitting unit 200 are substantially impedance matching.

The radiator 12 further includes a protrusion 12*c* connected to the conductive supporting portion 16. The protrusion 12*c* and the radiator 12 are substantially disposed in parallel. The protrusion 12*c*, the conductive supporting portion 16 and the grounding portion 14 further define a slot s2 having a closed end and an opening end. The direction of the opening of the slot s2 is parallel to the radiator 12.

The length and width of the slot s2 and the protrusion 12*c* are related to the length of the current path of the radiator 12 and the impedance of the radiator 12 for adjusting and matching the impedance. In the present embodiment of the invention, both the slot s2 and the protrusion 12*c* have a predetermined length and width, so that when the radiator 12 operates in a first frequency band, the radiator 12 and the transmission unit 200 are substantially impedance matching.

Figure 3:
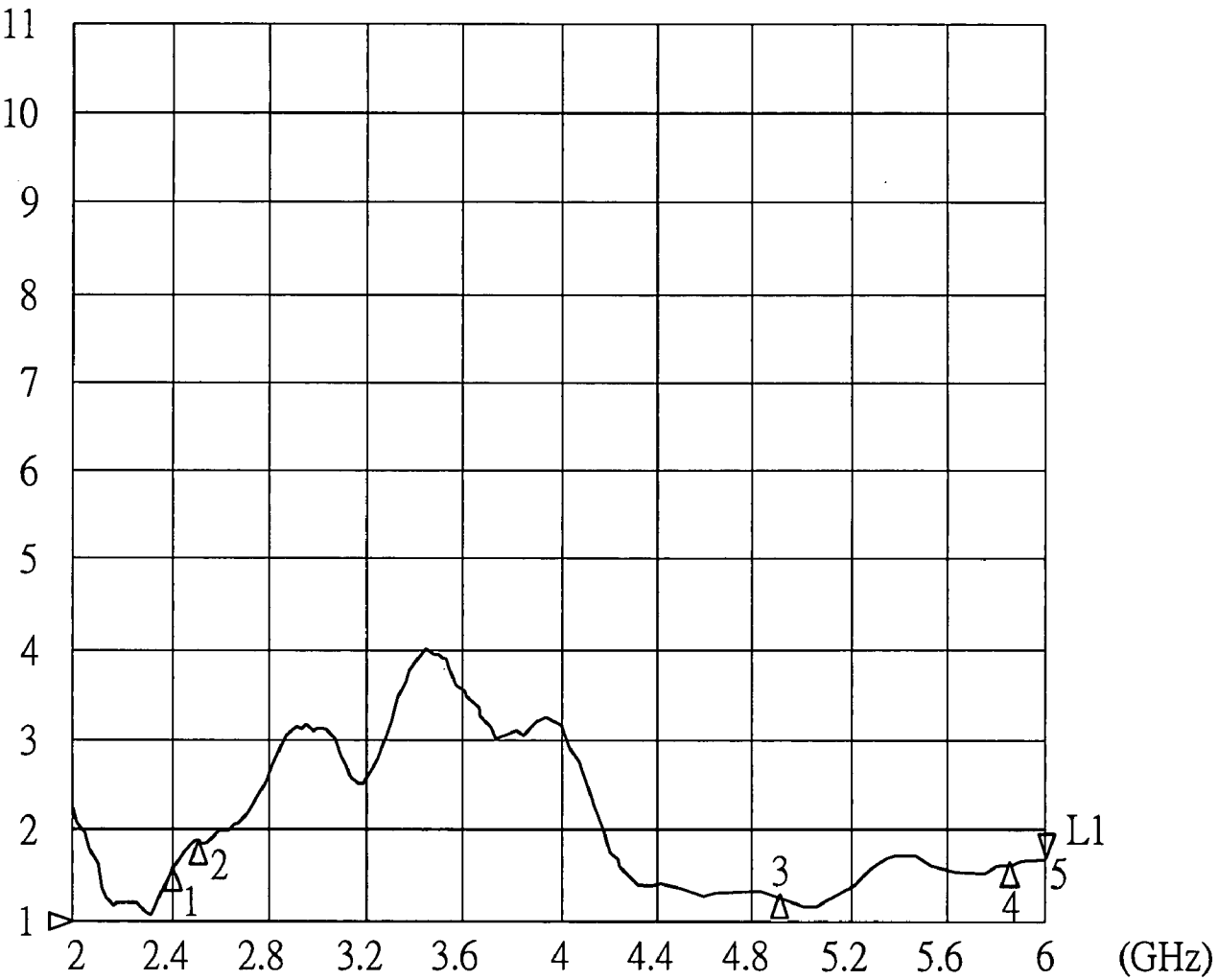
FIG. 3 shows a wave pattern of voltage standing wave ratio of the antenna 10 of FIG. 2.

Referring to FIG. 3, a wave pattern of voltage standing wave ratio of the antenna 10 of FIG. 2 is shown. According to the band-width reference line L1 where the voltage standing wave ratio (VSWR) is equal to 2, the first frequency band of the present embodiment of the invention substantially ranges from 2.1 GHz to 2.7 GHz, and the second frequency band substantially ranges 4.2 GHz to 6 GHz and over. The second frequency band is higher than the first frequency band. The first frequency band substantially includes a low frequency communication frequency band of 2.4 GHz-2.5 GHz defined in the communication protocol 802.11a/b/g/n. The second frequency band substantially includes a high frequency communication frequency band of 4.9 GHz-5.85 GHz defined in the communication protocol 802.11a/b/g/n. The actual VSWR values (denoted as measuring points 1-4 in FIG. 3) corresponding to 2.4 GHz, 2.5 GHz, 4.9 GHz and 5.85 GHz are 1.5641, 1.8521, 1.2693 and 1.6168, respectively. Thus, the antenna 10 disclosed in the present embodiment of the invention effectively supports data transmission adopting protocol 802.11 a/b/g/n.

Figure 4A:
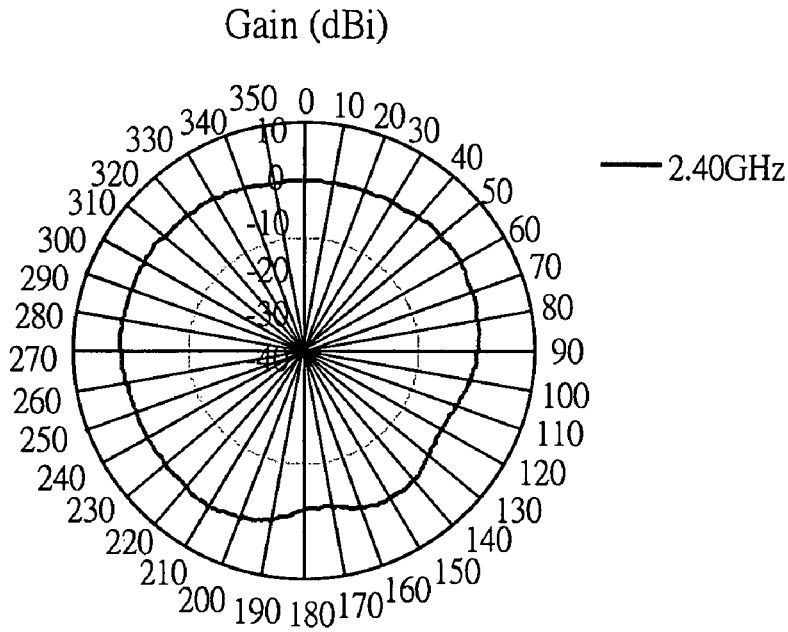
FIGS. 4A-4C respectively are vertical polarization field patterns of the antenna 10 of FIG. 2 operating in a communication frequency band of 2.40 GHz, 2.45 GHz and 2.50 GHz.
Figure 4B:
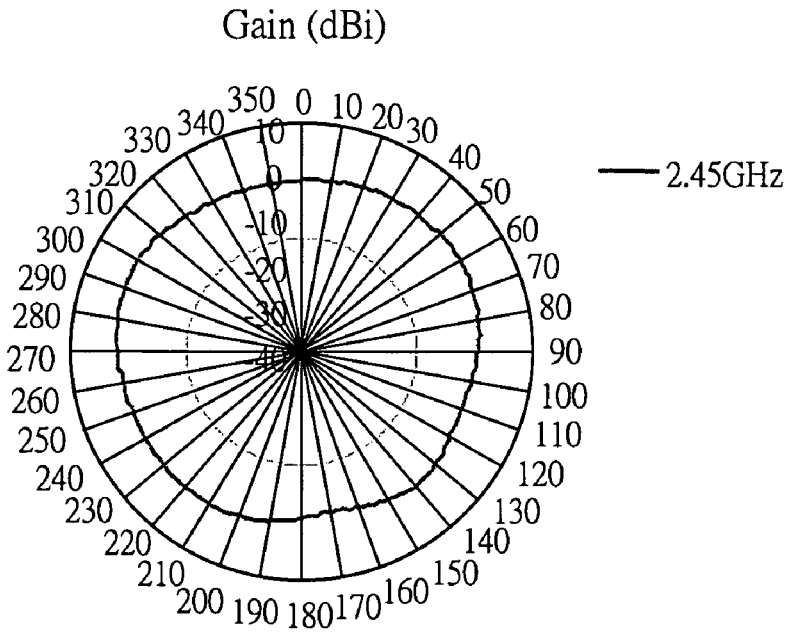
Figure 4C:
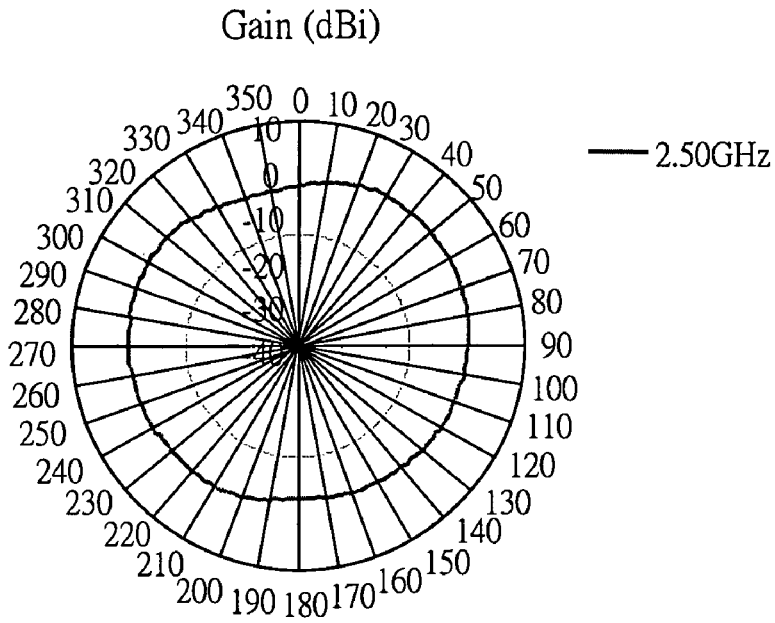
Figure 5A:
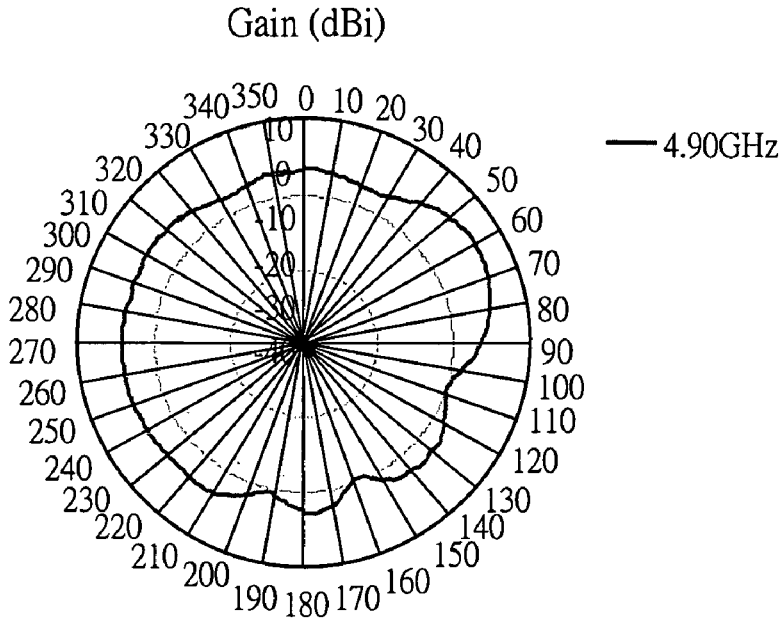
FIGS. 5A-5C respectively are vertical polarization field patterns of the antenna 10 of FIG. 2 operating in a communication frequency band of 4.90 GHz, 5.4 GHz and 5.850 GHz.
Figure 5B:
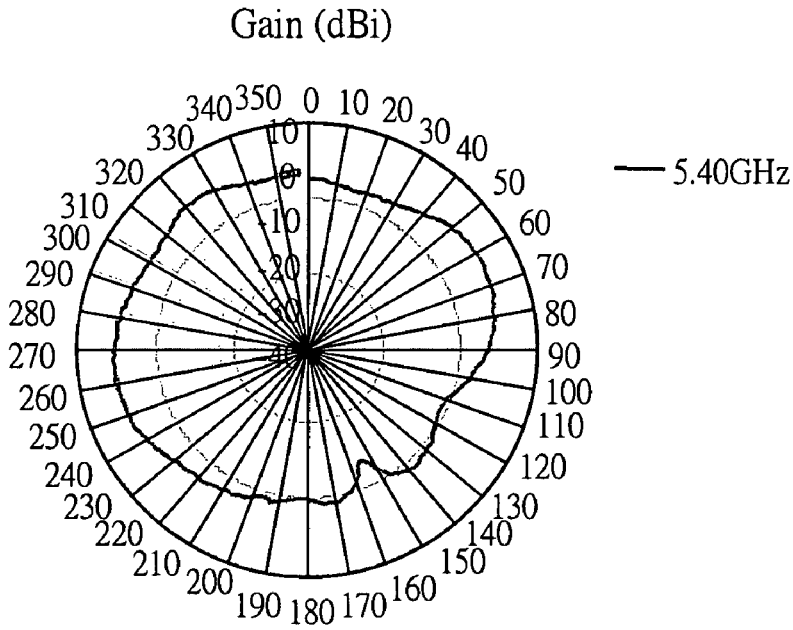
Figure 5C:
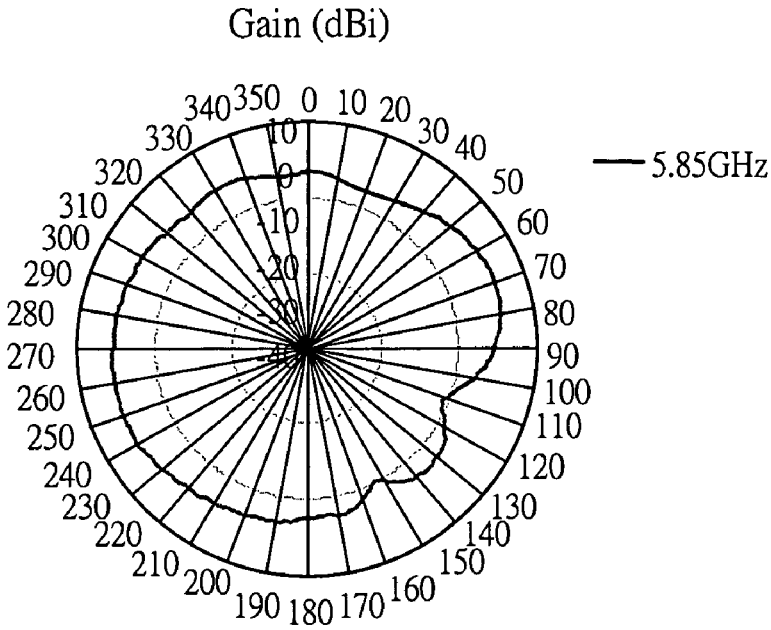

Vertical polarization field patterns of the gain of the antenna 10 are indicated in FIGS. 4A-4C and FIG. 5A-5C, and a relationship table of frequency vs. gain is indicated in FIG. 6. FIGS. 4A-4C respectively are vertical polarization field patterns of the antenna 10 of FIG. 2 operating in a communication frequency band of 2.40 GHz, 2.45 GHz and 2.50 GHz. FIGS. 5A-5C respectively are vertical polarization field patterns of the antenna 10 of FIG. 2 operating in a communication frequency band of 4.90 GHz, 5.4 GHz and 5.850 GHz. FIG. 6 shows a relationship table of frequency vs. gain of FIG. 4A-FIG. 4C and FIG. 5A-FIG. 5C.

Figure 7A:
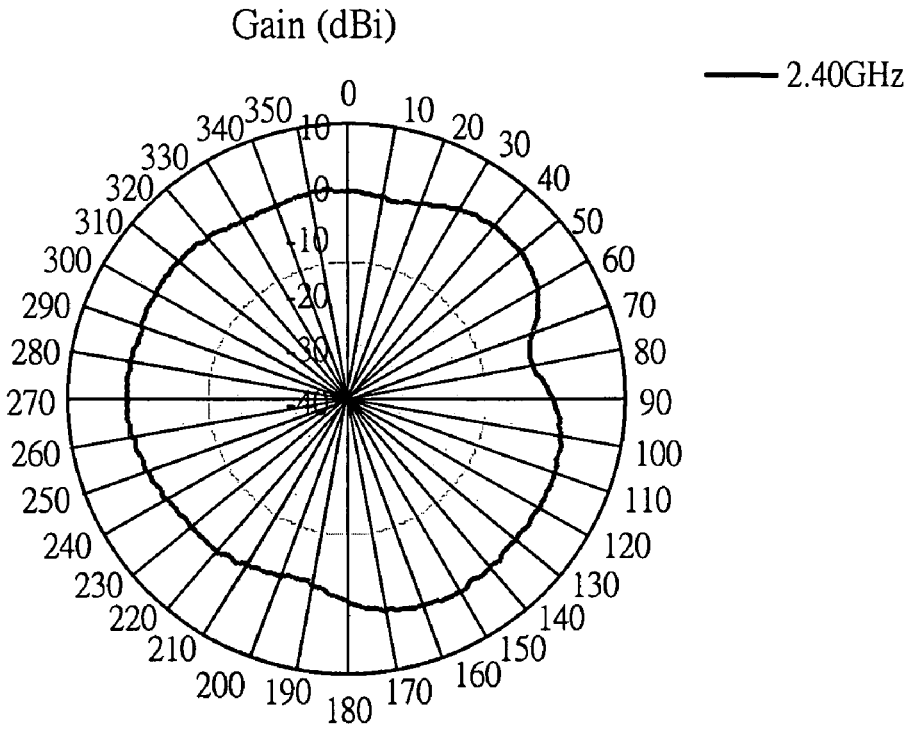
FIGS. 7A-7C respectively are horizontal polarization field patterns of the antenna 10 of FIG. 2 operating in a communication frequency band of 2.40 GHz, 2.45 GHz and 2.50 GHz.
Figure 7B:
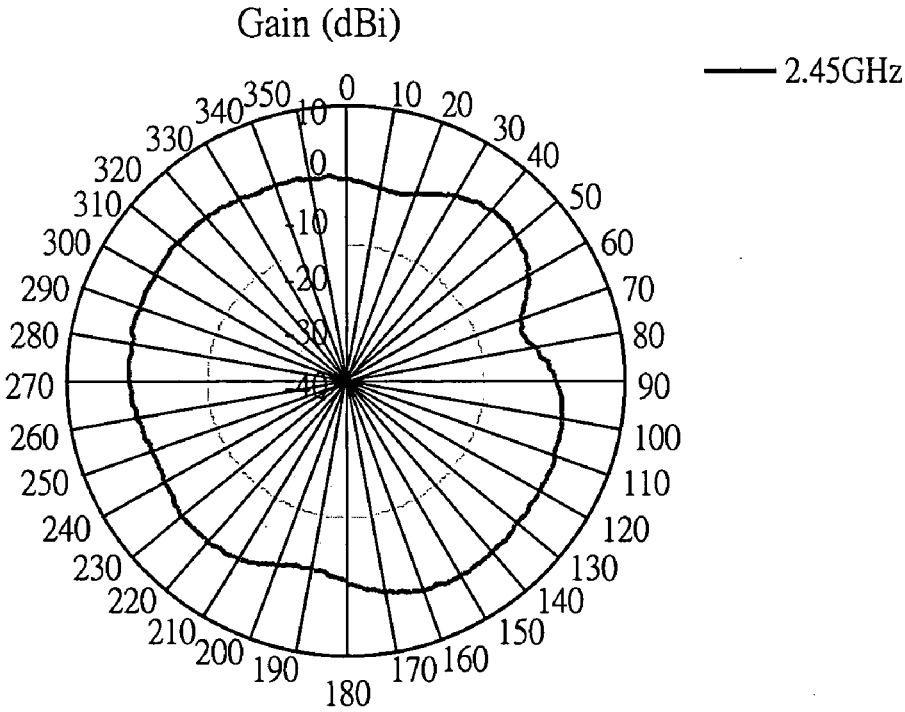
Figure 7C:
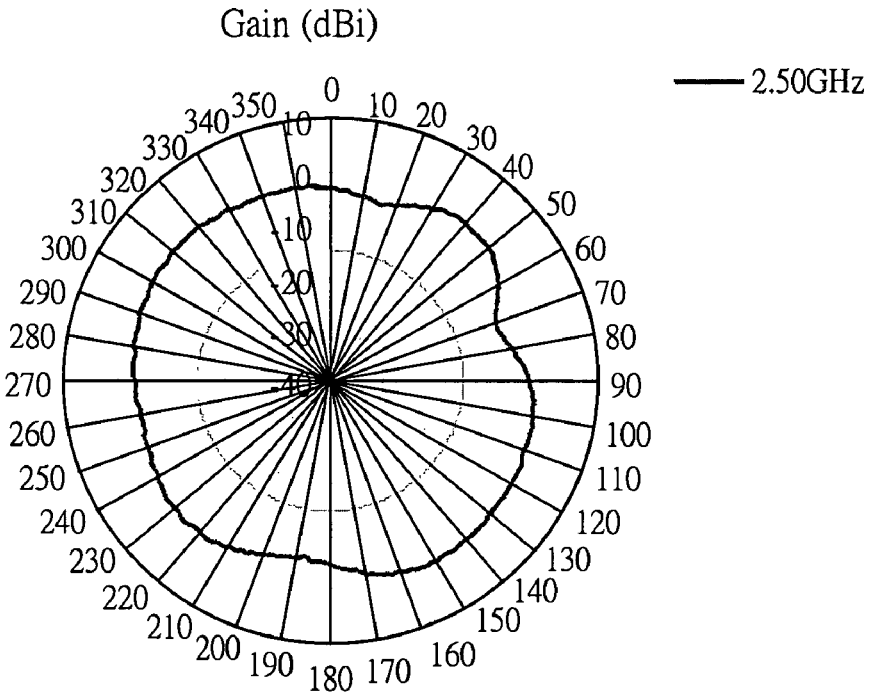
Figure 8A:
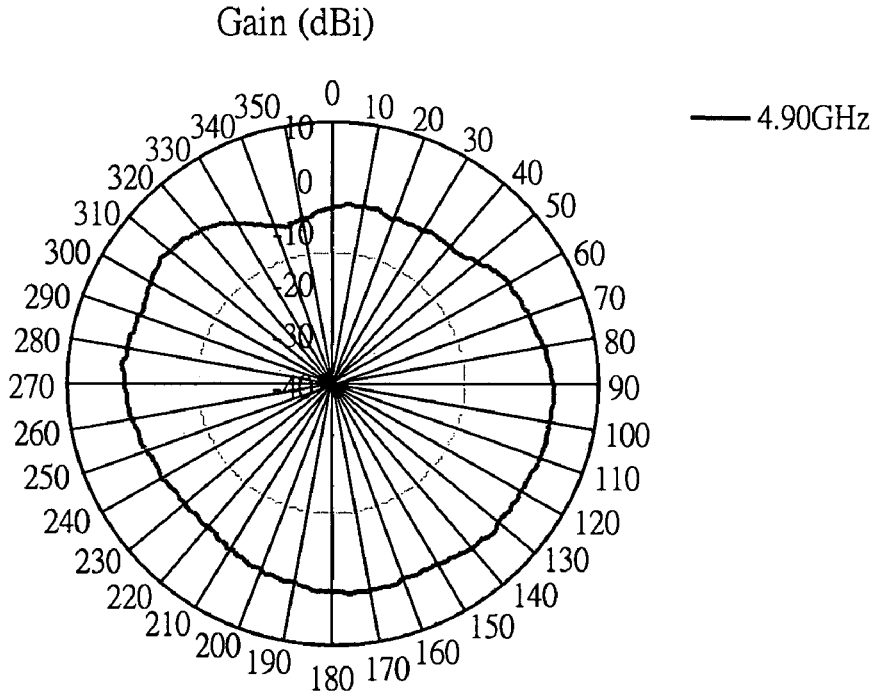
FIG. 8A-8C respectively are vertical polarization field patterns of the antenna 10 of FIG. 2 operating in a communication frequency band of 4.90 GHz, 5.4 GHz and 5.850 GHz.
Figure 8B:
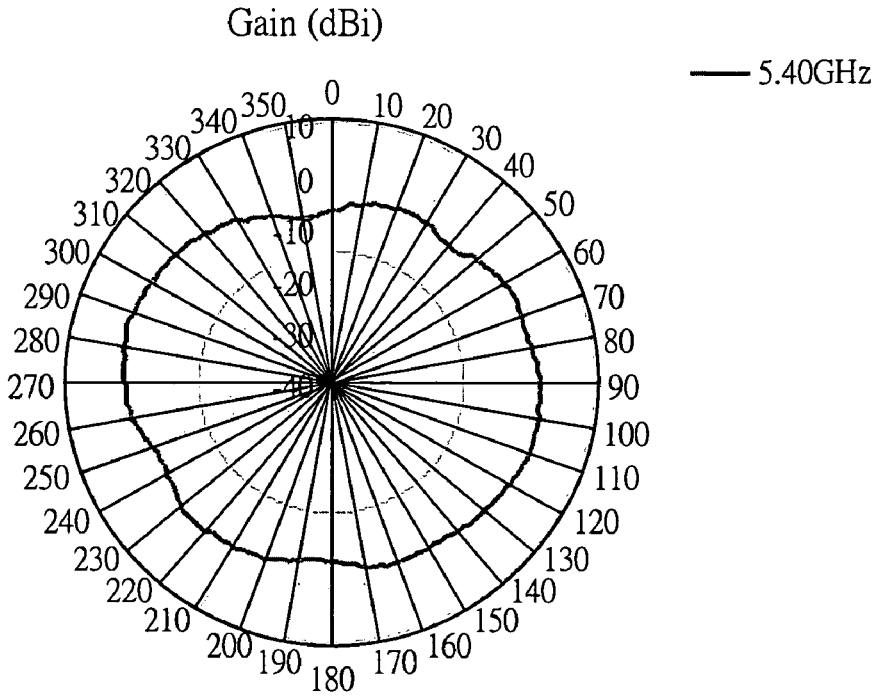
Figure 8C:
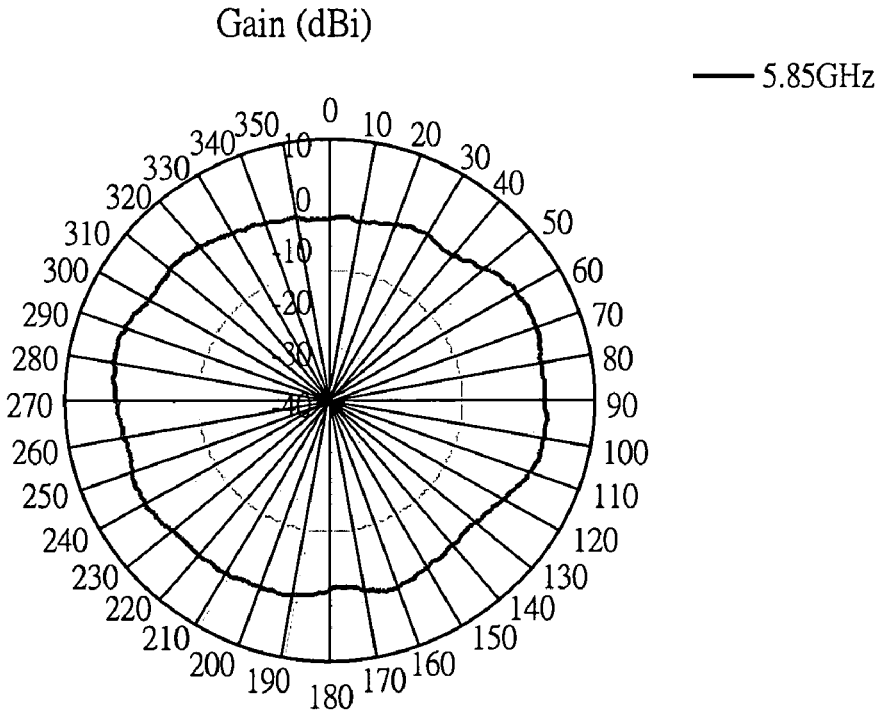

Horizontal polarization field patterns of the gain of the antenna 10 are indicated in FIG. 7A-7C and FIG. 8A-8C, and a relationship table of frequency vs. gain is indicated in FIG. 9. FIGS. 7A-7C respectively are horizontal polarization field patterns of the antenna 10 of FIG. 2 operating in a communication frequency band of 2.40 GHz, 2.45 GHz and 2.50 GHz. FIGS. 8A-8C respectively are vertical polarization field patterns of the antenna 10 of FIG. 2 operating in a communication frequency band of 4.90 GHz, 5.4 GHz and 5.850 GHz. FIG. 9 shows a relationship table of frequency and gain of FIGS. 7A-7B and FIGS. 8A-8B.

Figure 10:
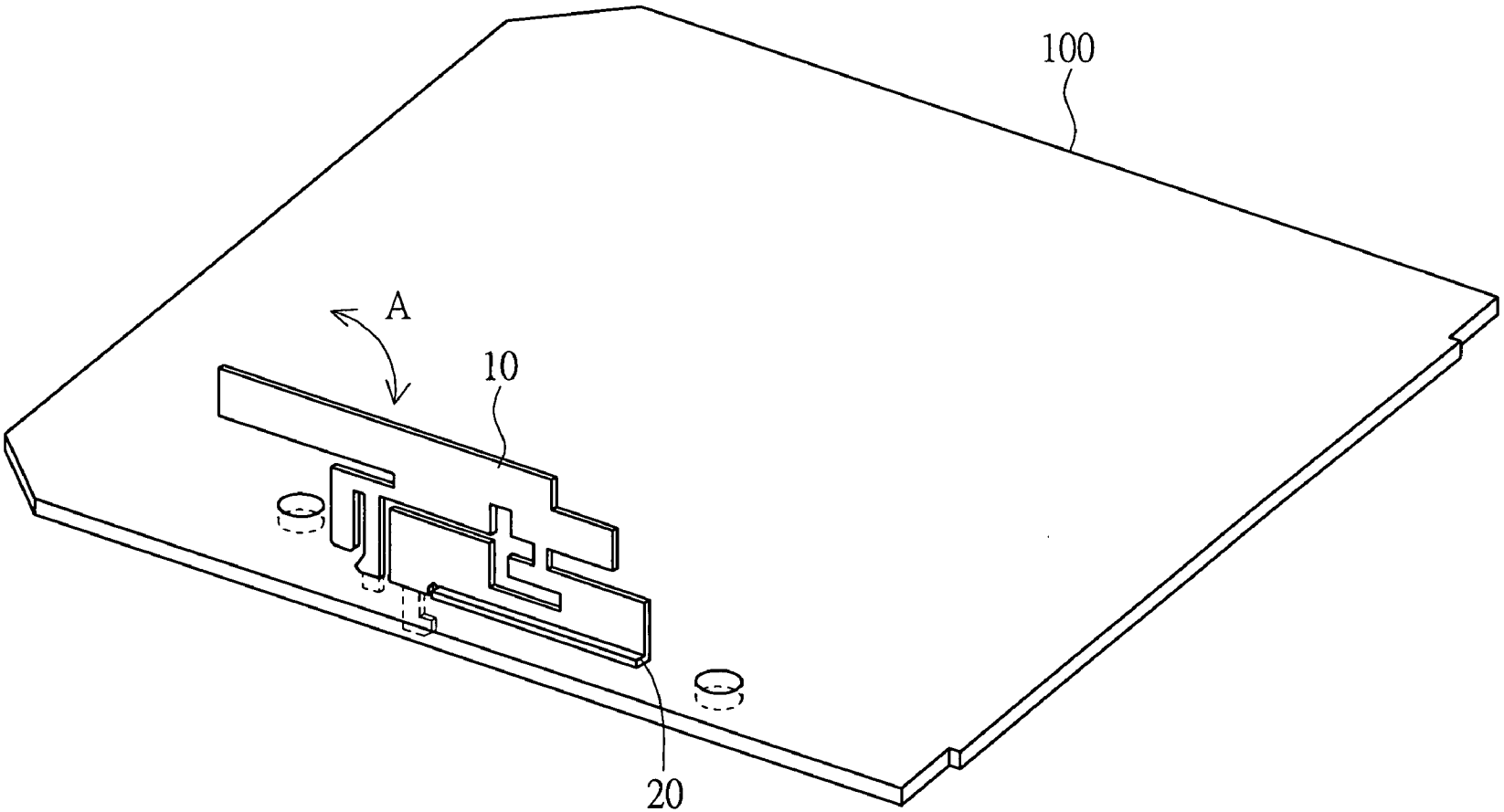
FIG. 10 shows another 3-D perspective of the antenna 10 of FIG. 1.

In the present embodiment of the invention, the antenna 10 further has a fixing mechanism for fixing the antenna 10 onto the PCB 100. Examples of the fixing mechanism include a lateral plate 20 as indicated in FIG. 10. The lateral plate 20 is extended from the bottom of the grounding portion 14 of the antenna 10, and the contained angle between the lateral plate 20 and the antenna 10 is equal to 90 degrees for example. The lateral plate 20 is parallel to the PCB 100 for vertically fixing the antenna 10 onto the PCB 100 lest the antenna 10 might rotate in a direction A with respect to the PCB 100.

In the present embodiment of the invention, the fixing mechanism is exemplified as the lateral plate 20. However, the design of the fixing mechanism of the antenna 10 is not limited to being the lateral plate 20, and other designs capable of achieving substantially the same fixing effect would do as well.

In the present embodiment of the invention, the slot s1 and the top surface uf are disposed in parallel to each other. However, the direction of the slot s1 is not limited to being parallel to the top surface uf, and other forms of correspondence would also do. The directions of the openings of the indentations n1 and n2 are not limited to being perpendicular to each other, and other forms of correspondence would also do.

The antenna disclosed in the present embodiment of the invention has a feeding branch and a grounding branch respectively extended from a radiator and a grounding portion of the antenna to a signal transmitting unit and a grounding unit on a PCB for receiving a feeding signal and a grounding signal. Thus, compared with conventional PIFA, the antenna disclosed in the present embodiment of the invention feeds in signals without using a soldered coaxial cable, hence avoiding the cost of the coaxial cable and the coming off problem. During the automatic production process, the feeding branch and the grounding branch can be soldered together on the circuit board with other elements, so that the antenna can be firmly fixed onto the circuit board without using additional process.

Moreover, compared with the conventional PIFA, the antenna disclosed in the present embodiment of the invention can be easily erected on a PCB.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An antenna set on a circuit board having a signal transmitting unit and a grounding unit, the antenna comprising:

a conductive supporting portion;

a radiator operating in a first frequency band, the radiator comprising:

a feeding branch coupled to the signal transmitting unit for receiving a feeding signal; and a grounding portion electrically connected to the radiator through the conductive supporting portion, the grounding portion comprising:

a slot cavity extended from a top surface of the grounding portion into the interior of the grounding portion; and a grounding branch coupled to the grounding unit;

wherein, the radiator and the cavity form a resonant cavity operating in a second frequency band.

2. The antenna according to claim 1, wherein the cavity comprises a first slot having a first closed end and a first opening end, the direction of the opening of the first slot is parallel to the top surface, and the length and width of the first slot are related to the frequency level of the second frequency band.

3. The antenna according to claim 1, wherein the radiator comprises:

a first indentation, wherein the direction of the opening of the first indentation and the radiator substantially are perpendicular to each other, the first indentation and the resonant cavity are interconnected, and the size of the first indentation is related to the frequency level of the second frequency band.

4. The antenna according to claim 1, wherein the radiator, the conductive supporting portion and the grounding portion together define a second indentation, the direction of the opening of the second indentation and the bottom surface are substantially parallel to each other, the second indentation and the resonant cavity are interconnected, and the size of second opening is related to the frequency level of the second frequency band.

5. The antenna according to claim 1, wherein the radiator further comprises:

a first protrusion substantially neighboring the feeding branch, wherein the length and width of the first protrusion are related to the level of the second frequency band.

6. The antenna according to claim 1, wherein the radiator further comprises:

a second protrusion connected to the conductive supporting portion, wherein the length and width of the second protrusion are related to the level of the first frequency band.

7. The antenna according to claim 6, wherein the second protrusion, the conductive supporting portion and the grounding portion further define a second slot having a second closed end and a second opening end, the direction of the opening of the second slot is parallel to the radiator body, and the length and width of the second slot is related to the level of the first frequency band.

8. The antenna according to claim 1, wherein the feeding branch and the grounding branch are extended down to the other lateral side of the circuit board for coupling the antenna onto the circuit board.

9. The antenna according to claim 1, wherein the grounding portion further has a fixing mechanism for vertically fixing the antenna onto the circuit board.

10. The antenna according to claim 1, wherein the radiator, the conductive supporting portion and the grounding portion are formed in the same planar structure.

11. The antenna according to claim 1, wherein the antenna is a planar inverse-F antenna (PIFA).

* * * * *